United States Patent [19]

Sahira et al.

[11] Patent Number: 4,906,438

[45] Date of Patent: Mar. 6, 1990

[54] NI BASE ALLOY FOR SPARK PLUG ELECTRODES OF INTERNAL COMBUSTION ENGINE

[75] Inventors: Kensho Sahira; Hideo Kitamura; Akira Mimura; Nobuyoshi Kurauchi, all of Saitama, Japan

[73] Assignee: Mitsubishi Kinzoku Kabushiki Kaisha, Tokyo, Japan

[21] Appl. No.: 248,559

[22] Filed: Sep. 23, 1988

[51] Int. Cl.[4] ..... C22C 19/00

[52] U.S. Cl. ..... 420/455; 420/459

[58] Field of Search ..... 420/455, 459, 460; 148/429

[56] References Cited

FOREIGN PATENT DOCUMENTS

| | | |
|---|---|---|
| 674068 | 4/1949 | United Kingdom . |
| 885544 | 6/1958 | United Kingdom . |
| 1347236 | 1/1970 | United Kingdom . |

*Primary Examiner*—R. Dean

*Attorney, Agent, or Firm*—Fitch, Even, Tabin & Flannery

[57] ABSTRACT

An Ni base alloy for use in spark plug electrodes for internal combustion engines which consists essentially by weight of:

0.5 through 1.5% Si;
0.7 through 2.8% Mn;
0.25 through 4.5% Al; and optionally 0.005–1% of one or more elements selected from the group consisting of Y and rare earth elements; and the remainder Ni and incidental impurities.

1 Claim, No Drawings

NI BASE ALLOY FOR SPARK PLUG ELECTRODES OF INTERNAL COMBUSTION ENGINE

FIELD OF THE INVENTION

The present invention relates to an Ni base alloy having especially excellent melting loss resistance, corrosion resistance and oxidation resistance at elevated temperatures and therefore suitable for use in spark plug electrodes for internal combustion engines.

BACKGROUND OF THE INVENTION

Spark plug electrodes for internal combustion engines, such as automobile engines, have conventionally been made of an Ni alloy of the type described, for example, in Japanese Patent Publication No. 43897/85, which consists essentially (in weight terms) of 0.2–3% Si, less than 0.5% Mn, one or more selected from the group consisting of 0.2–3% Cr, 0.2–3% Al, and 0.01–1% Y, the remainder being Ni and incidental impurities.

Recently, attempts have been made to produce automobile engines of high efficiency by the use of super chargers, such as turbo chargers, and the adoption of a dual overhead cam shaft system. In such high efficiency engines, the temperature of the combustion chambers in the automobile engine is elevated to a higher level than ever attained and the operating conditions of the spark plug electrodes and their surrounding environment are thus extremely harsh. However, as conventional Ni alloys exhibit poor melting loss resistance despite their excellent high temperature corrosion resistance and oxidation resistance, spark plug electrodes made of such a conventional Ni alloy cannot withstand practical use for long periods of time under such harsh operating conditions and the life of conventional electrodes is naturally rather short.

SUMMARY OF THE INVENTION

The present invention relates to a novel Ni base alloy having better melting loss resistance than the conventional ones and which consists essentially by weight of 0.5–1.5% Si, 0.7–2.8% Mn, 0.25–4.5% Al, optionally 0.005–1% of one or more elements selected from the group consisting of Y and rare earth elements, the remainder comprising Ni and incidental impurities.

DETAILED DESCRIPTION OF THE INVENTION

In view of above-mentioned circumstances the inventors have studied ways of providing the conventional Ni base alloy with high melting loss resistance and have found that, if Mn is incorporated in the conventional Ni base alloy in an amount of 0.7–2.8%, the resultant Ni alloy enjoys improved melting loss resistance as well as other physical properties suitable for use in spark plug electrodes for internal combustion engines without having its excellent high temperature oxidation resistance and corrosion resistance impaired.

This invention has been accomplished on the basis of these findings and is characterized by a novel Ni base alloy suitable for use in spark plug electrodes for internal combustion engines which consists essentially by weight of 0.5–1.5% Si, 0.7–2.8% Mn, 0.25–4.5% Al, optionally 0.005–1% of one or more elements selected from the group consisting of Y and rare earth elements, the remainder comprising Ni and incidental impurities.

The above-mentioned alloying elements are contained in the following ranges for the technical reasons described below.

(a) Si

The Si incorporated in the Ni base alloy greatly improves the high temperature oxidation resistance. If the Si content is less than 0.5%, the desired improvement in the high temperature oxidation resistance cannot be obtained. On the other hand, if the Si content exceeds 1.5%, the melting loss resistance of the Ni base alloy decreases abruptly. Consequently, the Si content is preferably in the range of 0.5–1.5%.

(b) Mn

The Mn exhibits a deoxidizing and desulfurizing effect when added to the molten Ni base alloy and remarkably improves the melting loss resistance after being incorporated in the Ni base alloy. If the Mn content is less than 0.7%, the desired level of melting loss resistance cannot be maintained, while on the other hand if the Mn content is more than 2.8%, the level of high temperature corrosion resistance is sharply reduced. Thus the Mn content is preferably in the range of 0.7–2.8%.

(c) Al

The Al incorporated in the Ni alloy heightens the high temperature corrosion and oxidation resistance. If the amount of Al goes below 0.25%, the desired level of high temperature corrosion and oxidation resistance cannot be attained. On the other hand, if the amount of Al goes above 4.5%, the workability of the resultant Ni base alloy will be deteriorated. Thus the Al content is preferably in the range of 0.25–4.5%.

(d) Y and rear earth elements

These elements are optionally added to the Ni base alloy as they improve both the high temperature corrosion resistance and the high temperature oxidation resistance. If the amount of one or more of these elements is less than 0.005%, the resultant alloy cannot exhibit the required high temperature properties to the desired extent. On the other hand, if the amount of one or more of these elements exceeds 1%, no further improvement in the high temperature properties can be obtained. The amounts of Y and rear earth elements are hence defined as being in the range of 0.005–1%, taking into consideration the need for economy.

Some examples of Ni base alloys in accordance with the present invention will next be explained in detail.

A series of Ni base alloys according to this invention (specimen Nos. 1 through 13) and another group of comparative Ni base alloys (specimen Nos. 1 through 5) were melted in an ordinary vacuum melting furnace, and then cast into ingots in vacuum. The composition of each of these alloys is shown in Table 1. Each of the resultant ingots was hot forged into a bar having a diameter of 10 mm and then drawn into a wire having a diameter of 3 mm. The wire obtained was cut into short pieces, each having a length of 10 mm, and long pieces, each having a length of 100 mm. These two sorts of wire pieces were used as test specimens for the high temperature corrosion test and oxidation test, respectively.

Next, the 10 mm-diameter bar was drawn into a finer wire having a diameter of 1 mm which was cut into small pieces for use as the center electrodes of spark plugs; another 10 mm-diameter bar was also drawn into a wire having a rectangular cross section of 2.5 mm×1.4 mm for use as the earth electrodes of spark plugs. These electrode test specimens were placed in an actually running engine, and their physical and chemical properties were measured with respect to the running engine in a car.

A high temperature corrosion resistance test was carried out as follows: each of the 3 mm-diameter test specimens which were 100 mm in length was placed in an alumina crucible, which was itself placed in an apparatus filled with a combustion gas atmosphere. Pb compound capable of forming PbO as a combustion product was continuously supplied to the combustion gas atmosphere at a constant feeding rate. Each of the test specimens was heated and kept at 800° C. for 50 hours in the apparatus. After that, the scale formed on the test specimen was rubbed off with a wire brush. The descaled test specimen that had been subjected to the corrosion test was compared in weight with the test specimen not subjected to the corrosion test to estimate the weight loss.

The high temperature oxidation resistance test was carried out as follows: each of the 3 mm-diameter test specimens which were 10 mm in length was put on an alumina boat which was placed in an electric furnace. Each of the test specimens was heated and kept at 800° C. for 100 hours in the ambient air, and the weight gain (oxidation gain) was then measured.

The running test was carried out by fitting an earth electrode and a center electrode, both made from the Ni alloy of the present invention, to the spark plug of a car, and the electrode was used to an extent equivalent to running the car for a distance of about 2 million km at a mean speed of 60 km/hr. Then, the consumption loss or thinning off of the earth electrode by the spark attack was measured so as to evaluate the melting loss resistance.

All these test results are shown in Table 1.

TABLE 1

| | | Composition (weight %) | | | | | High temp. corrosion resistance | High temp. oxidation resistance | Melting loss resistance Consumption |
|---|---|---|---|---|---|---|---|---|---|
| | | Si | Mn | Al | Y + RE | Ni + impurities | Weight loss ($mg/cm^2$) | Weight gain ($mg/cm^2$) | loss of earth electrode (mm) |
| Ni base alloy of this invention | 1 | 0.52 | 1.03 | 1.12 | — | Remainder | 4.7 | 2.9 | 0.16 |
| | 2 | 1.06 | 1.04 | 1.10 | — | " | 4.3 | 2.0 | 0.18 |
| | 3 | 1.48 | 0.94 | 1.12 | — | " | 3.8 | 1.9 | 0.22 |
| | 4 | 1.05 | 0.72 | 1.13 | — | " | 4.0 | 2.5 | 0.16 |
| | 5 | 1.04 | 2.77 | 1.09 | — | " | 4.6 | 3.1 | 0.10 |
| | 6 | 1.06 | 1.08 | 0.252 | — | " | 4.8 | 3.0 | 0.13 |
| | 7 | 1.10 | 1.06 | 4.49 | — | " | 3.2 | 1.5 | 0.19 |
| | 8 | 1.04 | 1.03 | 1.11 | Y 0.0052 | " | 3.9 | 1.7 | 0.14 |
| | 9 | 1.03 | 1.04 | 1.12 | Y 0.53 | " | 3.2 | 1.3 | 0.12 |
| | 10 | 1.05 | 1.00 | 1.08 | Y 0.92 | " | 3.0 | 1.1 | 0.12 |
| | 11 | 1.07 | 1.04 | 1.12 | Ce 0.032<br>Ce 0.051 | " | 3.5 | 1.6 | 0.15 |
| | 12 | 1.00 | 1.04 | 1.10 | Nd 0.018<br>La 0.024<br>Y 0.013 | " | 3.3 | 1.7 | 0.13 |
| | 13 | 1.02 | 1.02 | 1.09 | La 0.016 | " | 3.6 | 1.7 | 0.15 |
| Comparative Ni base alloy | 1 | 0.24* | 1.03 | 1.12 | — | Remainder | 5.4 | 5.0 | 0.20 |
| | 2 | 1.86 | 1.06 | 1.10 | — | " | 4.7 | 1.7 | 0.51 |
| | 3 | 1.03 | 0.21* | 1.13 | — | " | 4.9 | 2.6 | 0.45 |
| | 4 | 1.05 | 3.14* | 1.08 | — | " | 12.1 | 3.5 | 0.12 |
| | 5 | 1.08 | 1.02 | 0.07* | — | " | 6.5 | 4.2 | 0.18 |

*departed from the scope of this invention.

It will be apparent from the test results shown in Table 1 that all the test specimens Nos. 1 through 13 of the Ni base alloys according to this invention are excellent in all three of properties, i.e., high temperature oxidation and corrosion resistance and melting loss resistance, while the comparative test specimens Nos. 1 through 5, which are outside the scope of this invention in terms of the content of the elements marked *, are inferior to the test specimens of this invention with respect to at least one of these three properties. In particular, when the test specimens Nos. 1 through 13 of this invention are compared with the comparative test specimen No. 3 which was referred to above as being prior art, the former are clearly superior. It will be clearly understood that the former exhibits improved melting loss resistance over the latter.

As explained in detail above, since the Ni base alloys of this invention are excellent in high temperature corrosion and oxidation resistance and melting loss resistance, the high performance of spark plug electrodes for internal combustion engines formed from the Ni base alloys of this invention can be maintained for very long periods of time even if exposed to harsh operating conditions.

Although the present invention has been explained with reference to preferred examples, it will be clearly understood to those skilled in the art that the present invention is not restricted to such examples alone and that many variations and combinations can be made without departing from the spirit and scope of the present invention.

What is claimed is:

1. An Ni base alloy for use in spark plug electrodes for internal combustion engines which consists essentially by weight of:

0.5 through 1.5% Si;

0.7 through 2.8% Mn;

0.25 through 4.5% Al;

0.005 through 1% of one or more elements selected from the group consisting of Y and rare earth elements; and the remainder Ni and incidental impurities.

* * * * *

UNITED STATES PATENT AND TRADEMARK OFFICE

CERTIFICATE OF CORRECTION

PATENT NO. : 4,906,438

DATED : March 6, 1990

INVENTOR(S) : Kensho Sahira, Hideo Kitamura and Nobuyoshi Kurauchi

It is certified that error appears in the above-identified patent and that said Letters Patent is hereby corrected as shown below:

IN THE SPECIFICATION:

On the face of the patent, after the Filing Date, insert --Foreign Application Priority Data September 29, 1987 [JA] Japan ..... 244912/1987--.

In column 2, line 35, change the word "rear" to read the word --rare--.

In column 2, line 45, change the word "rear" to read the word --rare--.

Signed and Sealed this

Fourteenth Day of May, 1991

*Attest:*

HARRY F. MANBECK, JR.

*Attesting Officer*

*Commissioner of Patents and Trademarks*